United States Patent [19]

Deutsch et al.

[11] 4,282,786

[45] Aug. 11, 1981

[54] AUTOMATIC CHORD TYPE AND ROOT NOTE DETECTOR

[75] Inventors: Ralph Deutsch; Leslie J. Deutsch, both of Sherman Oaks, Calif.

[73] Assignee: Kawai Musical Instruments Mfg. Co., Ltd., Hamamatsu, Japan

[21] Appl. No.: 75,432

[22] Filed: Sep. 14, 1979

[51] Int. Cl.[3] ..... G10H 1/38; G10H 5/00

[52] U.S. Cl. ..... 84/1.01; 84/1.03; 84/DIG. 2; 84/DIG. 22

[58] Field of Search ..... 84/1.01, 1.03, 1.17, 84/1.24, DIG. 2, DIG. 22

[56] References Cited

U.S. PATENT DOCUMENTS

| | | | |
|---|---|---|---|
| 2,645,968 | 7/1953 | Hanert | 84/1.17 X |
| 3,889,568 | 6/1975 | Amaya | 84/1.01 |
| 4,019,417 | 4/1977 | Carlson | 84/1.01 |

*Primary Examiner*—Stanley J. Witkowski
*Attorney, Agent, or Firm*—Ralph Deutsch

[57] ABSTRACT

In an electrical keyboard musical instrument apparatus is provided for automatically selecting one of a library of chord types which is closest to a chord played on the instrument. The closest decision is made by processing the actuated keyswitch data by a set of matched filters each of which corresponds to a member of the library of chord types. The chord type decision is made to correspond to the matched filter producing the maximum output response. The selection between chord types yielding equal responses is resolved by priority logic based upon the frequency of chord usage. A root note is chosen for each selected chord type.

11 Claims, 4 Drawing Figures

AUTOMATIC CHORD TYPE AND ROOT NOTE DETECTOR

BACKGROUND OF THE INVENTION

1. Field of the Invention

This invention relates broadly in the field of electronic musical tone generators and in particular is concerned with the automatic detection of the chord type and root note played on a keyboard.

2. Description of the Prior Art

Musical chords can be defined as a combination of notes which sound "well" when played simultaneously. Chords are a set of notes with prescribed semi-tone intervals based upon a given tone which is called the root tone, or root note. If the root note is the lowest note of a chord the chord is said to be in the fundamental position, or normal order, or not inverted. If any note other than the root note is the lowest note then the chord is said to be "inverted" or in the inverted order. It is common practice to use inverted chords so that all the notes of a given chord are limited to a single octave of a keyboard musical instrument.

Because the selection and playing of chords requires both musical maturity and manual dexterity beyond the usual capabilities of a neophyte keyboard musical instrument player, a wide variety of aids have been developed so that the neophyte can play relatively advanced chordal harmonies with a minimum of skill.

Chord organs have been implemented in which the player selects the chord type and root note from a set of buttons much in the manner used for the bass accompaniment in accordians. In U.S. Pat. No. 2,645,968 Hanert discloses means to play chords selected from a set of buttons. The selected chord root and its musical fifth can be applied to a pedal tone generator by actuating one of two pedals.

Many of the current keyboard musical instruments of the organ family have provisions for semi-automatic modes for playing accompaniment chords and pedal tones. Some of these systems play the accompaniment in rhythmic patterns determined by the logic obtained from an automatic rhythm device. Moreover the pedal notes are altered in rhythmic patterns in which the selection of tones is transferred in a predetermined manner from the lower keyboard (left hand) and the rhythm timing is under control of a automatic device. In such systems for which the pedal note is determined from the accompaniment chords played on the lower keyboard, a detection subsystem is required to determine the proper root note for the actuated chords.

Various detection systems have been proposed and constructed for finding the root corresponding to a group of notes played on a particular keyboard. Many of these detection systems are very limited in that the player must preselect the kind of chords to be stored such as major and minor triads. Moreover some sort of default logic is required to take care of the almost nonsense situations in which incorrect or disonant note combinations are played on the lower keyboard (or any keyboard used to provide chord input data as a set of switches).

In U.S. Pat. No. 4,019,417 there is described a method for generating chords from notes actuated on a keyboard. A chord memory is provided which stores data for a preselected list of chord types. Logic is provided for "chord detection" based upon preselection of one or three note chord operation by the player. The chord detection logic determines whether the selected chord (one or three notes) is a "minor" or "major" chord. In addition, a root note is selected for the chord type decision. A priority logic is included which selects the root note of the lowest detected chord if more than one chord has been detected. Provision is also included for the case in which inverted chords are played on the input keyboard.

The prior art systems are primarily intended for begining players and limited in that the root note and chord type have to be given to the system. If the chord types are limited, then some simple root note and chord type selection has been accomplished such as in the system disclosed in U.S. Pat. No. 4,019,417. However, no provision has been made for more advanced players who can correctly play many chord types or for the transition skills between the beginner and expert player.

The present invention provides a novel means for detecting chord types and their root notes for a wide variety of chord types and incorporates features which permit operation even when either accidental mistakes or completely nonsense combinations of notes are played on the accompaniment keyboard.

SUMMARY OF THE INVENTION

The present invention is directed to a novel and improved arrangement for detecting the chord type played on a keyboard as well as the corresponding root note. Given the proper root note and the chord type, it is then possible to alternate the pedal notes between the root note and a musical interval depending upon the detected chord type.

In brief, the chord detection apparatus employs a multiplicity of matched filters. It is known in the signal theory art that a matched filter will provide for a noisy input signal an output signal that has a maximum signal-to-noise power ratio. Moreover the matched filter's impulse response is a reverse image of the signal. A discussion of these well-known properties can be found of page 163 of the book:

Ralph Deutsch, *System Analysis Techniques* Englewood Cliffs, N.J. Prentice-Hall, Inc., 1969.

The actuated multiplicity of notes on the accompaniment keyboard is translated to a binary serial pulse data stream. The serial data is passed through a set of seven matched filters. Using a threshold logic, the chord type from a preselected set of chord types is chosen which is "closest" in a mean-square signal sense to the actuated notes. At the same time the root note of the detected chord type is chosen.

It is a feature of the present invention that with a limited set of seven matched filters, almost every commonly used chord consisting of 1 to 5 notes can be detected.

An objective of the present invention is to provide means for making an optimum or best decision of chord type and root note even if incorrect or completely nonsensensical sets of notes are actuated to provide the input data.

Another object of the present invention is to provide chord and root note data without the requirement of preselecting chord types or preselecting the number of actuated notes.

BRIEF DESCRIPTION OF THE DRAWINGS

For a better understanding of the invention reference should be made to the accompanying drawings.

DETAILED DESCRIPTION OF THE INVENTION

Figure 1:
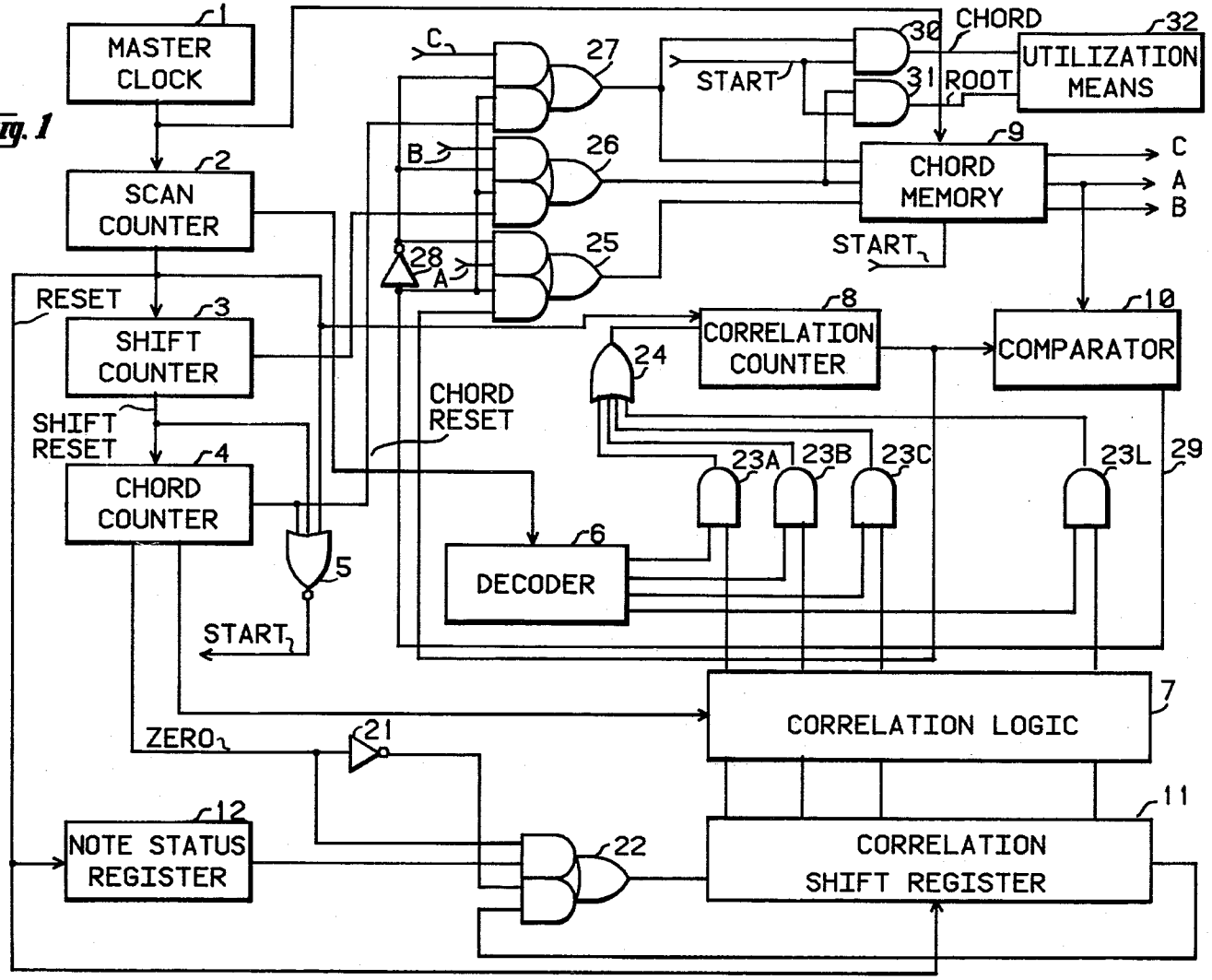
FIG. 1 is a schematic block diagram of an embodiment of the present invention.
Figure 3:
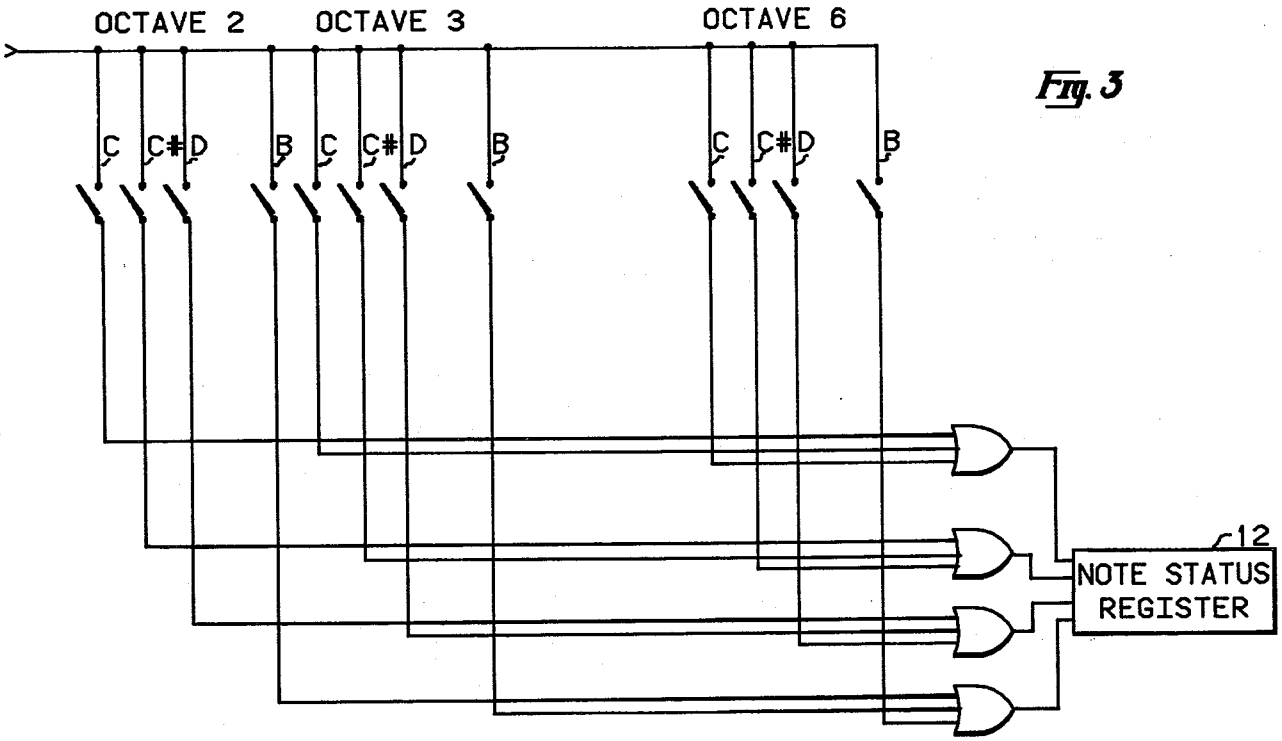
FIG. 3 is a schematic diagram of the keyboard switches.

FIG. 1 shows an embodiment of the present invention for detecting unknown chord types and their root notes. The instrument's keyboard switches, or note switches, are connected as shown in FIG. 3. All the notes in the scale are connected to all the same octavely related notes. That is $C_2$, $C_3$, $C_4$, $C_5$, $C_6$, and $C_7$, key status data are summed so that they act in parallel. The same arrangement is also used for all the other notes in the musical octave. In this fashion chord information can be obtained by actuating a set of keyboard switches anywhere on the keyboard. The particular octave in which the keyswitches are actuated has no effect on the input key switch status information. For such a connection array, the keys are said to be connected in paralleled octaves.

The chord data from the actuated keyboard switches is stored in note status register 12. The note status register is advantageously implemented as a paralleled loaded load 12 bit shift register. Each bit in this shift register corresponds to a specified note in the musical octave.

The timing of the logic functions shown in FIG. 1 is controlled by the master clock 1. The entire chord and root note detection logic requires $7\times12\times12=1008$ master clock timing pulses. For a master clock note of 1 Mhz, the detection logic requires about one millisecond. This time is short enough to be essentially instantaneous for an electronic musical instrument.

Scan counter 2 is a counter which is incremented by the master clock 1 and counts modulo 12. A RESET signal is generated by the scan counter 2 each time it resets itself to its initial state because of its modulo counting implementation. The initial state of a counter is the minimum value of its possible count states.

Shift counter 3 is a counter which is incremented by the RESET signals generated by the scan counter 2. Shift counter 3 counts modulo 12 and generates a SHIFT RESET signal each time the counter resets itself to its initial state because of its modulo counting implementation.

Chord counter 4 is a counter shich is incremented by the SHIFT RESET signals generated by the shift counter 3. Chord counter 4 counts modulo 7 and generates a CHORD RESET signal each time the counter resets itself to its initial state because of its modulo counting implementation.

When the count states of the scan counter 2, the shift counter 3, and the chord counter 4 have all been simultaneously incremented to their initial state, the NOR gate 5 will generate a START signal in response to a simultaneous "1" state for the RESET, SHIFT RESET, and CHORD RESET signals. The START signal initializes the process of determining the closest chord type and root note of the actuated key switch status data stored in the note status register 12.

Chord memory 9 is a register whose contents are initialized to zero value in response to the START signal created by the NOR gate 5. Chord memory 9 is divided into three segments. The segment 1 subregister is used to store the highest value of the correlation number obtained in a manner described below. The segment 2 subregister is used to store the chord type number corresponding to the current highest value of the correlation stored in the segment 1 subregister. The segment 3 subregister is used to store the note number of the chord corresponding to the current highest value of the correlation stored in the segment 1 subregister.

The count state of chord counter 4 is used to determine the present type of chord that is being used by the system to examine the current actuated key switch status data stored in the note status register 12. Table 1 lists the chord types corresponding to each state of the chord counter.

TABLE 1

| Chord counter state | Chord Type |
|---|---|
| 0 | Major |
| 1 | Major |
| 2 | Minor |
| 3 | Dominant 7'th |
| 4 | Diminished |
| 5 | Augmented |
| 6 | Major 7'th |

These chord types are used for illustrative purposes and do not represent a limitation of the present invention. Additional or other chord types can be used in a manner which is evident from the following description. The particular list of chord types shown in Table 1 was selected because these are the chord types most frequently used by the average keyboard instrument player.

It is noted that Table 1 lists two chord counter states for a major chord. As explained below this is done to accomodate the situation in which only a single keyboard switch has been actuated. It is convenient to consider a single note as a chord using a generic meaning of the term "chord" to include one or more notes played simultaneously. A single note chord is designated by default to be a major chord. The system can be readily implemented to use another chord type for the default of a one note chord if such a choice is desired.

When the START signal is created by the NOR gate 5, chord counter 4 will be in its initial, or zero count state. In response to the zero state signal from chord counter 4, the select gate 22 will transfer data read serially from note status register 12 to the correlation shift register 11.

Data is addressed out of the note status register 12 in response to the RESET signals created by scan counter 2. This data is transferred to the correlation shift register 11 only during the time interval in which chord counter 4, is in its zero state. For the remainder of the 7 states of the chord counter 4, the data previously loaded into the correlation shift register 11 during the zero state is shifted in the normal end-around operation mode for a shift register. The end-around data circulation is controlled by the Inverter 21 in combination with data select gate 22. The correlation shift register 11 contains 12 bits, each corresponding to a note of the musical scale. An output data point is provided for each bit stored in this device.

The count states of the chord counter 4 are used to select the operating status of the correlation logic 7. The correlation logic 7 comprises circuitry which acts as a set of matched filter for each count of the chord types listed in Table 1. For each count state of the chord counter 4, Table 2 indicates whether or not an output from one the output ports of the correlation shift register is to be used as is, or if it will be inverted. A "1" entry in Table 2 indicates no bit inversion. The 12 data output ports are labelled for convenience as musical notes in Table 2. The first bit shift out of note status register 12 corresponds to the musical note B.

TABLE 2

| Chord | Correlation Shift Register Output | | | | | | | | | | | |
|---|---|---|---|---|---|---|---|---|---|---|---|---|
| Counter State | C | C# | D | D# | E | F# | G | G# | A | A# | B | |
| 0 | 1 | 0 | 0 | 0 | 1 | 0 | 0 | 1 | 0 | 0 | 0 | 0 |
| 1 | 1 | 0 | 0 | 0 | 1 | 0 | 0 | 1 | 0 | 0 | 0 | 0 |
| 2 | 1 | 0 | 0 | 1 | 0 | 0 | 0 | 1 | 0 | 0 | 0 | 0 |
| 3 | 1 | 0 | 0 | 0 | 1 | 0 | 0 | 1 | 0 | 0 | 1 | 0 |
| 4 | 1 | 0 | 0 | 1 | 0 | 0 | 1 | 0 | 0 | 1 | 0 | 0 |
| 5 | 1 | 0 | 0 | 0 | 1 | 0 | 0 | 0 | 1 | 0 | 0 | 0 |
| 6 | 1 | 0 | 0 | 0 | 1 | 0 | 0 | 1 | 0 | 0 | 0 | 1 |

Figure 2:
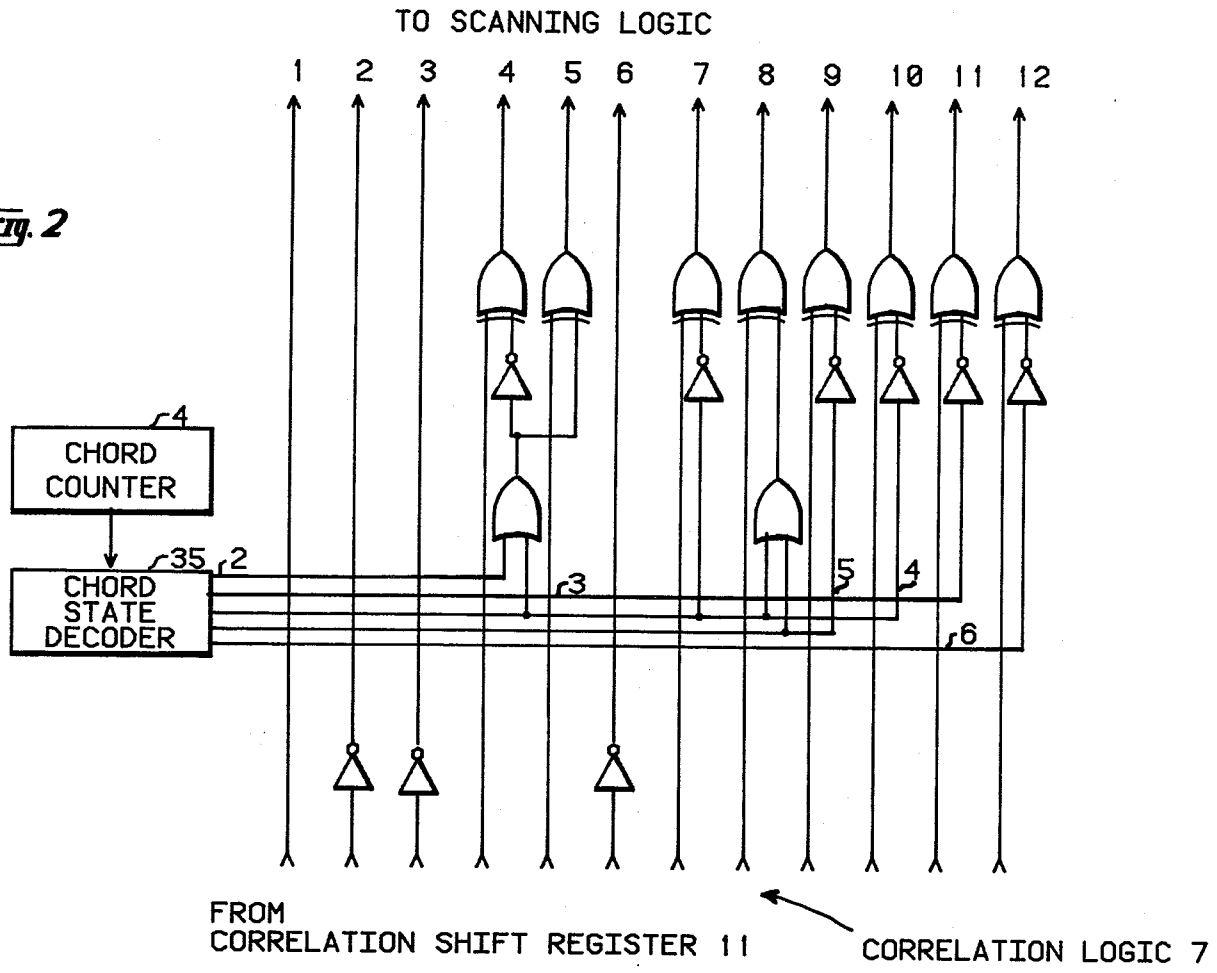
FIG. 2 is a schematic diagram of the correlation logic.

The details of the correlation logic 7 which implements the logic in Table 2 is shown in FIG. 2. Since the output of the first position (note C in Table 2) is always a "1", this transfer can be "hardwired" for all of the chord types. A similar constancy of a "0" exists for output positions 2,3, and 6. These positions are accomodated for all chord types by using a fixed bit inverter as shown in FIG. 2.

The scanning logic shown in FIG. 1 consists of the combination of the decoder 6, the set of 12 AND gates 23A through 23L, and the OR gate 24.

Each time that the scan counter 2 is reset because of its modulo counting action, a RESET signal is generated which is used to advance the data being read out of the note status register 12. The same RESET signal is also sent to advance the data stored in the correlation shift register 11. Therefore there are 12 clock intervals from the master clock 1 assigned to each programmed state of the logic in the correlation logic 7. For each count state of the scan counter 2, decoder 6 decodes the binary coded state of the scan counter to one of 12 output signal lines. These 12 output signal lines in conjunction with the 12 AND gates 23A to 23L, causes the output data lines from the correlation logic 7 to be sequentially scanned and the scanned data is sent to the OR gate 24.

Each time that an output signal from the correlation logic 7 is scanned by the decoder 6 and one of the set of AND gates 23, is found to be in a "1" state, the OR gate 24 transfers this "1" state to increment the correlation counter 8.

The correlation counter 8 is incremented by signals received from OR gate 24. This counter is implemented to count modulo 12 which is the maximum number of "1" state signals that can be received by scanning the output signals from the correlation logic for any given state of the chord counter 4.

The correlation counter 8 is placed in its initial state by the RESET signal generated each time that the scan counter 2 is reset because of its modulo 12 counting implementation.

In the fashion described previously, the content of the correlation counter at the end of any scan cycle of 12 counts of counter 2, will be the correlation number, or the cross-correlation number, of the input data contained in the note status register 12 and the current associated chord associated with the state of the chord counter 4. Moreover, the root note of the chord associated with this cross-correlation number will be the count state of the shift counter 3. It is customary to call the cross-correlation number by the abbreviated term of "correlation number" when no ambiguity arises of whether the correlation is between two different signals or with one signal and itself.

As described above, when the scan counter 2 resets itself because of its modulo counting implementation, the correlation counter 8 is reset thereby enabling it to start a new correlation count. The comparator 10 is constantly comparing the highest previously detected correlation number value contained in the segment 1 of the chord memory 9 with the current count state of the correlation counter 8. If it is found that the value of the correlation number in the correlation counter 8 is greater than the current maximum value stored in segment 1 of the chord memory 9, the new maximum value is stored in this memory segment.

The output line A from the chord memory 9 corresponds to the stored correlation numbers in segment 1. Since the maximum correlation number value is 12, the segment 1 memory consists of 4 binary bits. The output line A represents a set of 4 lines, although for drawing simplicity only one such line is shown in FIG. 1 to represent the entire set of lines. In the same fashion, the single signal line from the correlation counter 8 to the comparator 10 represents a similar set of 4 signal lines.

The data select gate 25 is one of a set of 4 identical select gates. Each one of these data select gates is associated with one of the 4 lines containing the current count state of the correlation counter 8.

If the comparator 10 finds that the current value in the correlation counter 8 is less than or equal to the current value stored in segment 1 of the chord memory 9, a "0" state signal is placed on line 29 by the comparator 10. In response to "0" signal on line 29 and the signal inversion action of the invertor 28, the data select 25 will cause the data on line A to be rewritten into segment 1 of the chord memory 9.

If the comparator 10 finds that the current value in the correlation counter 8 is greater than the current value stored in segment 1 of the chord memory 9, a "1" state signal is placed on line 29 by the comparator 10. In response to a "1" signal on line 29, the data select 25 will transfer the current state of the correlation counter 8 to be stored in segment 1 of the chord memory 9.

The single output line B shown in FIG. 1 represents a set of 4 lines containing the 4 bits of binary data stored in segment 2 of the chord memory 9. These 4 bits designate one of the 12 notes in the musical octave. Similarly the data select gate 26 represents one of a set of 4 identical select gates corresponding to each of the 4 bits used to designate a note in the musical octave.

If a "0" signal is present on line 29, then the current stored root note number found on line B is transferred by the select gate 26 to be rewritten in segment 2 of the chord memory 9. If a "1" signal is present on line 29, the current state of shift counter 3 is transferred by data select gate 26 to be written in segment 2 of the chord memory 9. This new value corresponds to the root note for a new detected maximum value of the correlation counter 8.

The single output line C from the chord memory 9 represents a set of 3 lines containing the 3 bits of binary data stored in segment 3 of the chord memory 9. These 3 bits designate one of the 7 chord types corresponding to the library of chord types listed in Table 1. Similarly the data select gate 27 represents one of a set of 3 identical select gates corresponding to each of the 3 bits used to designate one of the 7 chord types in the implemented library set of chords.

If a "0" signal is present on line 29, then the current stored chord type found on line C is transferred by the select gate 27 to be rewritten in segment 3 of the chord memory 9. If a "1" signal is present on line 29, the current state of chord counter 4 is transferred by data select gate 27 to be written in segment 3 of the chord memory 9. This new value corresponds to the chord type for a new detected maximum value of the correlation counter 8.

It should be noted that the comparison logic described above provides a desirable detection priority for the chord types. The priority is that listed in Table 1 with a major chord having the highest priority. The listed priorities correspond with the usual frequency of usage of this set of chords in playing popular music. In the preferred embodiment of the present invention, a major chord is given the greatest priority and a major 7'th chord is given the least priority. In the described embodiment of the invention, if two or more chord types yield identical correlation values, the decision is automatically make to select the chord type having the highest priority.

The preferred embodiment also automaticaly encompasses the situation in which "nonsense" information is presented to the detection system by actuating a set of keyboard switches that does not correspond to any of the implemented library of chord types or, in fact, to any musical chord. For example, the input might consist of 2 to 5 consecutive notes in the musical scale. Even for such "nonsense" data input, the detection system will select a chord type and root note. The selection, as in all other cases, is based upon a "closest" measure to one of the library of chord types. "Closest" is measured as that chord type that produces the largest value of the correlation number and wherein the existance of a plurality of equal values is resolved by the above described chord type priority decision implementation.

At the end of a complete correlation for the library of 7 chord types, the best available chord type and root note decision is available from the set of AND gates 30 and 31. AND gate 31 represents 1 of a set of 3 identical AND gates and AND gate 31 represents 1 of a set of 4 identical AND gates.

The chord type and root note information available at the end of each complete cycle of detection is transferred to the utilization means 32. There are many configurations for the utilization means 32 depending upon the musical effects desired. The chord type and root note can be used to provide the input data to an automatic arpeggio generator. The root note can be used to play pedal notes which can also be played rhythmically by interrupting the pedal keying line by means of an automatic rhythm device. The pedal note can be made to sound in rhythm as well as to alternate between the root note and other notes obtained from the detected chord type data.

It is not necessary to have the musical instrument directly sound the notes that are actuated on the lower keyboard. For example, a beginner may wish to have only the closest detected chord sound and not the actuated notes. In this fashion, mistakes or incorrect chords are corrected by having the instrument sound only those chords detected by the chord and root note detection system.

Figure 4:
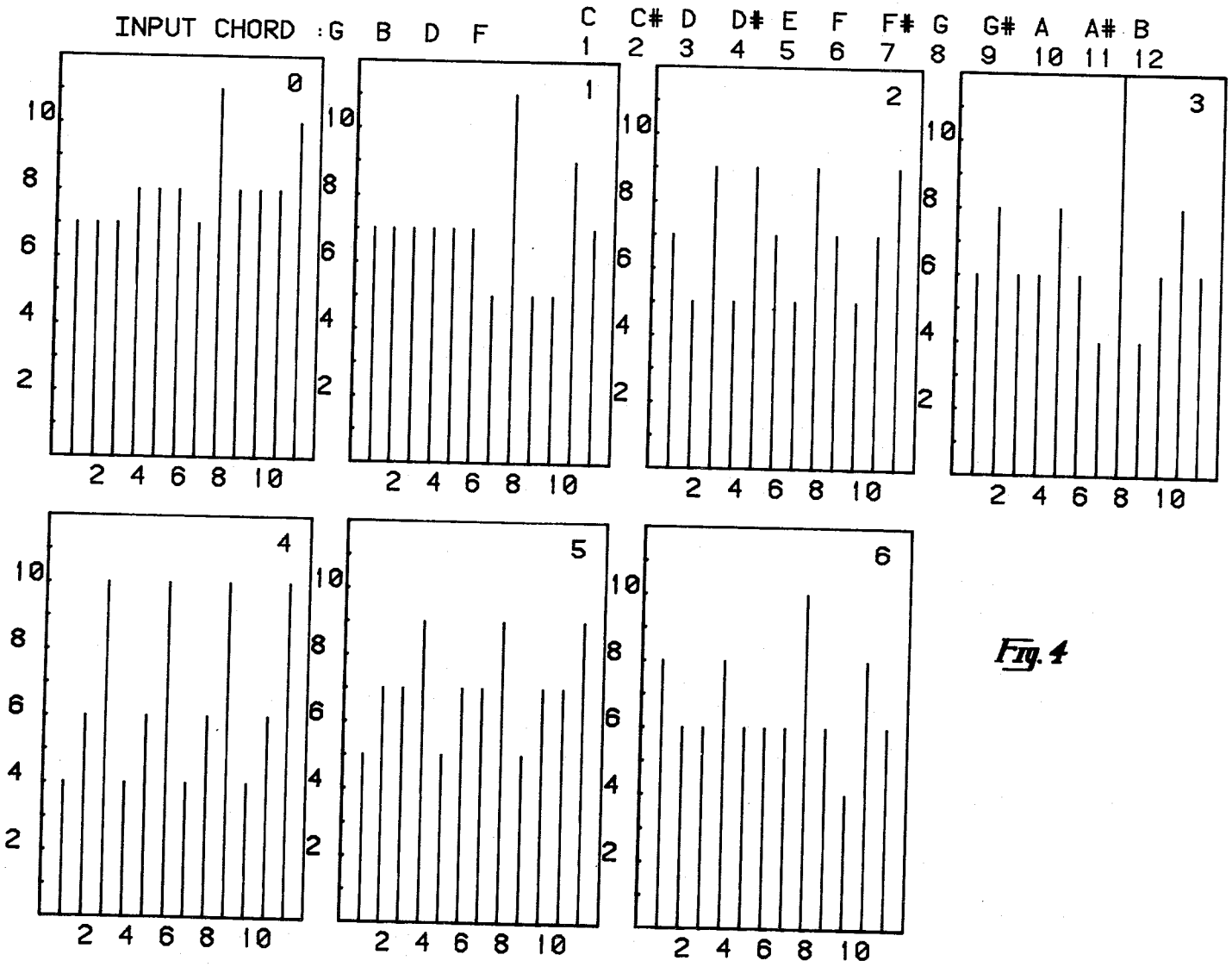
FIG. 4 is a drawing illustrating the chord and root note detection decisions.

When the keyboard switches are connected in parallel octaves as shown in FIG. 4 the keyboard switch data will cause keyed chords to become inverted if the chord notes are not all played within a single octave. For example, if the major chord consisting of the actuated key notes G♯2, C3, D♯3 is played, the detection system shown in FIG. 1 and previously described will detected a major chord consisting of the notes C,D♯,G♯ with G♯ as the root. The inversion will still sound musically correct and no problem is encountered with the G♯ root note as it is the root of both the original and inverted chord. Chord inversion is not an inherent characteristic of the present invention, but rather is a result of obtaining input note data information from a keyboard in which the keyswitches are connected in paralleled octaves. For example if a A minor seventh chord is keyed with the notes $A_3$, $C_4$, $E_4$, $G_4$, then because of the octave inversion wiring the input data is the chord C, E, G, A. The system shown in FIG. 1 will detect this as a C sixth chord with note C as the root note.

The decisions made by the system shown in FIG. 1 for one to five note chords are summarized in the following list.

One note chord (i) system will select a major chord with the detected note chosen as the root note.

Two note chords (i) minor 2nd: selects major chord with the higher note chosen as the root note.

(ii) major 2nd: selects major chord with the higher note chosen as the root note.

(iii) minor 3rd: selects major chord with the root note a major 3rd below the lower note.

(iv) major 3rd: selects major chord with lower note chosen as root note.

(v) 4th: selects major chord with higher note chosen as root note.

(vi) Two consecutive notes: selects major with higher note chosen as root note.

Three note chords (i) major—selects major chord with lowest note as root.

(ii) minor—selects minor chord with lowest note as root.

(iii) 3-note diminished: selects a dominant 7th chord containing the 3 notes with root note a major third lower than the lowest of the three notes.

(iv) augmented: selects augmented chord with one of original notes as root note.

(v) three consecutive notes: selects a major chord with highest note chosen as root note.

Four note chords (i) dominant 7th—selects dominant seventh (ii) minor 7th, or major 6th—selects a major chord as a major 6th (i.e. if input is C,D♯,G,A♯, selects D♯ major chord) with root note that for a major 6th chord.

(iii) diminished 7th—selects diminished seventh with one of original notes as root note.

(iv) major seventh—selects major 7th.

Five note chords (i) 9th chord—selects 7th chord with the same root note.

(ii) major 9th chord—selects major 7th chord with the same root note.

FIG. 4 is a diagram which illustrates the operation of the matched filter correlation detection logic of the system shown in FIG. 1. For illustration, the input chord was selected as the sequence of notes G, B, D, F. This sequence spans more than one octave. Because of the folding, or inversion produced by having the keyswitches connected in parallel octaves, the input data is presented to the system as the sequence of notes D, F, G, B.

The upper right table in FIG. 4 lists the musical note number convention for an octave in which C is the first note number.

Each of the graphs in FIG. 4 corresponds to one of the seven chord types listed in Table 1. The ordinates in the graphs represent the magnitude of the correlation number in the correlation counter at each displacement of data in the correlation shift register 11. The maximum correlation number value occurs for chord type 3 and note number 8. Thus the system selects a dominant 7th chord with G as the root note. This corresponds correctly with the input data.

The system shown in FIG. 1 can readily be modified to detect chords that span two octaves without inverting the chord. A chord is said to span more than one octave if the notes lie in more than one octave using the convention that octave 2 consists of the notes C2 through B2, octave 3 consists of the notes C3 through B3, etc. To prevent chord inversion caused by connecting the keyswitches in parallel octaves, each key is directly connected to an individual input port of the note status register 12. A preferred embodiment is one in which only two octaves of the lower keyboard are connected to the note status register 12. The player must restrict himself to these two octaves when he desires to input data to the chord and root note detection system. The use of two octaves is not a limitation of the invention but is used only for illustration. The extension to more than two octaves is evident. However, two octaves is a realistic choice because a musician cannot readily span more than two octaves with one hand.

To encompass a two octave input data set requires some minor changes in the system shown in FIG. 1 and previously described. The note status register 12 is a parallel input shift register having a length of 24 bits corresponding to two octaves of input note data.

The correlation shift register 11 is doubled in length to 24 bits to accomodate the entire data set that is transferred to it from the note status register 12.

The correlation logic 7 must be extended to 24 data inputs. This extension is accomplished by duplicating the logic shown in FIG. 2 and adding 12 inverter gates for added data lines 13 through 24.

The scan counter 2 is now implemented to count modulo 24.

The shift counter 3 is now implemented to count modulo 24.

No change is required for the chord counter 4.

The decoder 6 is implemented to decode the 24 binary states of the scan counter 2 into a set of 24 individual output signal lines.

The set of 12 AND gates 23 is enlarged to a set of 24 AND gates to correspond to the 24 output signal ports from the correlation logic 7.

The correlation counter 8 is now implemented to count modulo 24.

The segment 1 register of chord memory 9 is enlarged to 5 bits and the select gate 25 is enlarged to a set of 5 similar select gates.

The segment 2 register of chord memory 9 is enlarged to 5 bits and the select gate 26 is enlarged to a set of 5 similar select gates. Five bits are now required for the root note which can lie in a two octave range of 24 notes.

The set of AND gates 31 is enlarged to a set of 5 similar AND gates.

In the embodiment of the invention as previously described, the detection priority was given to the highest played notes in selecting a root note. This priority was obtained by reading data from the note status register in a sequence starting from the highest to the lowest note in the musical octave. The priority can be reversed by reading data out in a sequence starting from the lowest note. A similar change must be made in the correlation logic in inverting the order of the correlation logic.

The embodiment of the invention shown in FIG. 1 can also be described in the following fashion using signal theory terminology.

The input data from keyswitches connected in parallel octaves are stored in note status register 12. This data is converted into a time domain signal by shifting the data out of note status register to the correlation shift register 11 in response to the reset signals generated by the scan counter 2. The correlation shift register 11 is a device which acts to provide output data corresponding to the input key data in a succession of cyclically permutated data order. That is, if the input data set consists of the 12 states al, a2, . . . , a12. The first cyclically permutated output will be a2, a3, . . . , a12, al. The second cyclically permutated output will be a3, a4, . . . , a12, al, a2; and so on. The cyclically permutated outputs are generated in response to the reset signals from the scan counter 2.

A library of matched filters are contained in the correlation logic 7. These matched filters correspond to musical chords. The matched filters are used as transfer functions to process the data present at the output of the correlation shift register 11. For each of the cyclically permutated states of the data in the correlation shift register, the output data is processed by a selected matched filter, or transfer, function. The processing consists of a bit-by-bit multiplication of each bit of the output data by an associated bit of the matched filter which is also a binary sequence because it is by definition a reversed image of the chords in the form of a binary digit sequence.

The output of the transfer function processing is obtained by summing the individual bit-by-bit multiplication. This sum is called the correlation number. More precisely, it is known as the cross-correlation number of the input data and the matched filter.

The combination of the correlation counter 8, comparator 10, select gate 25, and chord memory 9 act as a selection means to obtain and store the maximum value of the correlation number obtained by processing the input data by all the members of the library of matched filters. Ties in the magnitude of the correlation number are resolved by a priority implemented by the order in which the matched filters are stored and accessed by the chord counter 4.

The comparator 10 acts as a decision means in selecting the chord types and root notes.

We claim:

1. Apparatus for selecting a musical chord type and its root note from a set of preselected musical chord types in a musical instrument having a keyboard with a plurality of key switches comprising:

a clock providing a sequence of timing signals, a status memory means for storing data corresponding to actuated note switches in said plurality of key switches, a first memory means for storing data to be thereafter read out, a transfer means whereby data is read from said status memory and stored in said first memory, a second memory means for storing a plurality of transfer functions each corresponding to a musical chord type, a correlation evaluation means responsive to selected members of said plurality of transfer functions and responsive to data accessed from said first memory wherein a plurality of correlation numbers are generated, a third memory means wherein a correlation number is stored to be thereafter read out, a comparison means for comparing the magnitude of each of said plurality of correlation numbers with the correlation number stored in said third memory means wherein a correlation number having the maximum magnitude value is selected and stored in said third memory means, and a selection means responsive to said timing signals and said correlation number having a maximum magnitude value wherein a selection is made of a musical chord type from said preselected musical chord types and a selection is made of a corresponding root note.

2. Apparatus for selecting a musical chord and its root note according to claim 1 wherein said clock further comprises;

a master clock for generating a sequence of timing signals, a scan counter incremented by said sequence of timing signals wherein said scan counter counts modulo the number of data words stored in said status memory and wherein a reset signal is created when said scan counter is reset at its maximum count, a shift counter incremented by said reset signals wherein said shift counter counts modulo the number of data words stored in said status memory and wherein a shift reset signal is created when said shift counter is reset at its maximum count, and a chord counter incremented by said shift reset signals wherein said said chord counter counts modulo the number of said plurality of transfer functions and wherein a chord reset signal is created when said chord counter is reset at its maximum count.

3. Apparatus for selecting a musical chord and its root note according to claim 2 wherein said transfer means comprises;

coincidence circuitry wherein a start signal is generated in response to a simultaneous creation of said reset signal, said shift reset signal, and said chord reset signal, and memory addressing means responsive to said start signal wherein data is addressed out from said status memory means each time said reset signal is created by said scan counter.

4. Apparatus according to claim 3 wherein said memory addressing means further comprises;

a memory access logic means responsive to the count state of said chord counter whereby data addressed out from said status memory means is stored in said first memory means when said count state attains its minimum value, and a memory address decoding means responsive to said reset signals wherein data is accessed from said first memory means in a cyclic permutation order.

5. Apparatus according to claim 4 wherein said correlation evaluation means further comprises;

a function select means responsive to count states of said chord counter whereby a corresponding member of said plurality of transfer functions is selectively read out from said second memory means in response to each count state of said chord counter, a multiplication means wherein data accessed from said first memory means is multiplied by said transfer function read out by said function select means thereby generating a plurality of product values, and an adder means wherein said plurality of product values are summed to generate said correlation numbers in said plurality of correlation numbers.

6. Apparatus according to claim 5 wherein said comparison means further comprises;

a comparison selection means wherein each member of said plurality of correlation numbers generated by said adder means is compared with said correlation number stored in said third memory means and wherein the correlation number having the largest magnitude value is selected and stored in said third memory means, and a selection signal generator means wherein a selection signal is generated when said comparison selection means selects said correlation number having the largest magnitude.

7. Apparatus according to claim 6 wherein said selection means further comprises;

a chord type memory means for storing data to be thereafter read out, a root note memory means for storing data to be thereafter read out, and a selection memory address means responsive to said selection signal wherein the count state of said chord counter is stored in said chord type memory means and wherein the count state of said shift counter is stored in said root note memory means.

8. Apparatus according to claim 1 wherein said second memory means further comprises;

an addressable memory storing a plurality of data words corresponding to said plurality of transfer functions wherein each member of said plurality of data words comprises a binary number having bit values forming a matched filter for said corresponding musical chord type.

9. Apparatus according to claim 2 wherein said second memory means further comprises;

transfer function logic circuitry responsive to state of said chord counter wherein each said state selects logic gates comprising a matched filter for said corresponding chord type.

10. A musical instrument having a keyboard with a multiplicity of keyswitches in which apparatus for selecting the closest musical chord type and its root note corresponding to actuated keyswitches comprises;

a master clock means for generating a sequence of timing signals and a start signal corresponding to an initial timing signal, keyswitch connection circuitry whereby said multiplicity of keyswitches are electrically connected in parallel octaves, a status memory for storing the state of said keyswitch connection circuitry, a correlation memory means for storing data, a transfer means responsive to said start signal whereby data is transferred from said status memory to said correlation memory means, a transfer function memory means storing a plurality of matched filters each of which corresponds to a musical chord type, a first memory addressing means responsive to said master clock means whereby a matched filter is selected from said transfer function memory means, a matched filter processor means wherein data stored in said correlation memory means is processed by each of said selected matched filter thereby generating a plurality of correlation numbers, and a decision means responsive to said plurality of correlation numbers wherein a selection is made of the matched filter which causes the generation of a correlation number having a maximum value.

11. A musical instrument according to claim 10 wherein said decision means further comprises;

priority assignment means wherein said plurality of chord types are assigned priority values, and priority selection means wherein a priority selection is made between two said correlation numbers having equal value using said assigned priority values thereby selecting the correlation number corresponding to the largest of said assigned priority values.

* * * * *